US005180052A

United States Patent [19]

Smith et al.

[11] Patent Number: 5,180,052

[45] Date of Patent: Jan. 19, 1993

[54] DISPLAY TRAY

[75] Inventors: Raymond D. Smith, Cincinnati; Janet A. Reckers, Loveland, both of Ohio

[73] Assignee: Chesapeake Display and Packaging Company, Winston Salem, N.C.

[21] Appl. No.: 756,152

[22] Filed: Sep. 6, 1991

[51] Int. Cl.[5] ..... B65D 23/12

[52] U.S. Cl. ..... 206/45.11; 206/45.19; 206/485; 206/564; 229/120.08; 229/164; 229/915

[58] Field of Search ..... 206/44.11, 45.11, 45.12, 206/45.16, 45.19, 483, 485, 564; 229/120.08, 164, 915, DIG. 11

[56] References Cited

U.S. PATENT DOCUMENTS

| | | | |
|---|---|---|---|
| 2,339,176 | 1/1944 | Lee . | |
| 2,511,569 | 6/1950 | Davis et al. . | |
| 2,620,962 | 12/1952 | Powell | 206/45.19 |
| 2,630,914 | 3/1953 | Bekoff | 206/45.19 |
| 2,893,621 | 7/1959 | Harnish et al. | 229/DIG. 11 |
| 3,009,622 | 11/1961 | Leone | 206/45.19 |
| 3,913,739 | 10/1975 | Hennessey . | |
| 3,927,761 | 12/1975 | Boyle | 206/485 |
| 3,955,745 | 5/1976 | Forrer . | |
| 3,986,628 | 10/1976 | Prodel . | |
| 4,053,101 | 10/1977 | Hart, Jr. | 229/164 |
| 4,067,474 | 1/1978 | Prodel . | |
| 4,185,744 | 1/1980 | Peterson . | |
| 4,206,869 | 6/1980 | Gurevitz | 229/164 |
| 4,353,496 | 10/1982 | Nelson, Jr. et al. | 229/DIG. 11 |
| 4,355,717 | 10/1982 | Oliff . | |
| 4,382,505 | 5/1983 | Sutherland et al. . | |
| 4,394,903 | 7/1983 | Bakx . | |
| 4,416,411 | 11/1983 | Desmond et al. . | |
| 4,485,922 | 12/1984 | Desmond et al. | 206/45.19 |
| 4,489,880 | 12/1984 | Calvert . | |
| 4,606,457 | 8/1986 | Pugh . | |
| 4,753,241 | 6/1988 | McIntyre | 229/164 |
| 4,798,291 | 1/1989 | Carver . | |
| 4,832,199 | 5/1989 | Rigby | 206/485 |
| 4,875,586 | 10/1989 | Chaussadas . | |
| 4,878,612 | 11/1989 | Schuster . | |
| 5,039,002 | 8/1991 | Spamer | 229/915 |

FOREIGN PATENT DOCUMENTS

| | | | |
|---|---|---|---|
| 540280 | 4/1942 | United Kingdom | 206/45.19 |

*Primary Examiner*—David T. Fidei

*Attorney, Agent, or Firm*—Bell, Seltzer, Park & Gibson

[57] ABSTRACT

In accordance with the present invention, there is disclosed a display tray having a tray body with a bottom wall, opposing front and rear walls and an open top. At least one support wall is spaced between the rear walls and extends upward from the bottom wall to define a plurality of article carrying rows. A plurality of openings are positioned in the front, rear or support walls adjacent to the bottom wall for receiving projections of articles to be carried in the display tray and retaining the articles in the article carrying rows. In one embodiment, a bottom wall flap member overlies the bottom wall and is folded to form at least one support wall spaced between front and rear walls and extending upward from the bottom wall to form a plurality of article carrying rows. The bottom wall flap member includes front and rear upward extending flap wall members positioned adjacent the interior of respective front and rear walls of the tray body. The front and rear flap wall members and the support walls include a plurality of openings adjacent the bottom wall and dimensioned for receiving projections of articles to be carried in the display tray and retaining the articles in the article carrying rows.

13 Claims, 3 Drawing Sheets

DISPLAY TRAY

FIELD OF THE INVENTION

This invention relates to a display tray having a plurality of article carrying rows defined by front, rear and support walls and openings in the front, rear or support walls and adjacent the bottom wall for receiving projections of articles to be carried in the display tray and retaining the articles in the article carrying rows.

BACKGROUND OF THE INVENTION

Consumer products, such as solid deodorant sticks, typically are contained in a plastic body, such as an oval configured plastic carrying body. The carrying body usually includes a top lid for covering the carrying body and a circular adjustment knob positioned on the bottom of the body for controlling the amount of solid deodorant stick forced out of the carrying body.

These types of consumer articles are packaged typically in individual containers, boxes or vacuum sealed packages for display and marketing. The individual packaging of each product has market appeal, and for years this manner of marketing has been standard for the packaging of many different consumer products such as deodorant sticks. Recently, emphasis in packaging has shifted from packaging a product individually to packaging a plurality of the consumer products into one display tray or package for reducing the amount of waste the consumer must dispose. Individually packaged articles generate higher amounts of waste products in the form of discarded boxes, vacuum packages and other containers.

Preferably, a plurality of products are packaged in a point-of-purchase display tray or other means where the consumer can select the product directly from the tray. When the point-of-purchase display tray is empty, the display tray then is discarded. One of the drawbacks for such a point-of-purchase display tray is the apparent lack of means for retaining the articles in the display tray.

Some prior art proposals include packaging designs which have slot openings for receiving a bottom portion of the article to be retained. These proposals disclose packaging designs for retaining bottles and cans. Typically the packages are of the wrap-around type and include a top cover or wall for engaging the top portion of the bottle or can. The wrap-around nature of the package aids in retaining the articles in the package. However, there are drawbacks to this type of package design. Typically, a consumer must purchase the entire package and contents, and cannot selectively choose one bottle from the package without destroying the package. Examples of these designs are disclosed in U.S. Pat. Nos. 2,339,176, 4,382,505 and 4,875,586. Other packaging proposals disclosed in U.S. Pat. Nos. 3,986,628 and 4,067,471 to Prodel disclose open top packages with interconnecting side walls for individually storing bottles in separate compartments. This type of package allows withdrawal of bottles or other articles from the package without destroying the package. Nevertheless, this design proposal requires compartmentalizing the package which requires excess packaging material requirements and does not ensure adequate retention of the articles in the package.

SUMMARY OF THE INVENTION

In accordance with the present invention, there is provided a display tray which advantageously does not require compartmentalizing of the display tray for holding articles therein. In addition, the display tray of the present invention advantageously ensures adequate retention of articles in the display tray by receiving projections of the articles to be carried in the display tray and retaining the articles in the plurality of article carrying rows formed in the display tray.

In accordance with the present invention, the display tray comprises a tray body having a bottom wall, opposing front and rear walls and an open top and at least one support wall spaced between the front and rear walls and extending upward from the bottom wall to define a plurality of article carrying rows. A plurality of openings are positioned in the front, rear or support walls adjacent the bottom wall for receiving projections of the articles to be carried in the display tray and retaining the articles in the article carrying rows. The tray advantageously is formed from a single sheet of paper board material. Tray side wall panels serve as tray sidewalls and are tapered downward from the rear wall toward the front wall. In the preferred embodiment, the openings are formed in each of the front, rear and support walls to form cooperating pairs of openings for receiving projections of articles and retaining the articles within the article carrying rows.

In one embodiment, a bottom wall flap member overlies the bottom wall. The bottom wall flap member is folded to form at least one support wall spaced between front and rear walls and extending upward from the bottom wall to form a plurality of article carrying rows. The bottom wall flap member includes front and rear upward extending flap wall members positioned adjacent the interior of respective front and rear walls of the tray body. The front and rear flap members and support walls include a plurality of openings adjacent to the bottom wall and dimensioned for receiving projections of articles to be carried in the display tray and retaining the articles in the article carrying rows.

The rear flap wall member advantageously extends upward to the height of the rear wall and is integrally connected to the rear wall to form a rear wall having a multi-layered panel thickness. Tray side wall panels serve as tray side walls and each advantageously includes an interior wall panel having a portion of the lower edge spaced from the bottom wall and forming a slot opening adjacent the bottom wall. The bottom wall flap member includes side extensions dimensioned for fitting within the slot openings for maintaining the bottom wall flap member in overlying engagement with the bottom wall.

The bottom wall includes means for defining a tear-out flap panel and the rear wall includes means for receiving a tear-out flap panel from the bottom wall for allowing interconnection of a plurality of the display trays when stacking of the trays, one on top of the other. The means for defining a tear-out flap panel preferably comprises a fold line on the bottom wall. A portion of the bottom wall is defined by lines of weakening on the bottom wall and interconnecting the fold line. The tear-out flap member is separable from the bottom wall along the lines of weakening formed on the bottom wall for folding outward along the fold line.

One advantageous blank design for forming the display tray in accordance with the present invention also is disclosed. The blank comprises a rectangular blank having opposing side flap portions which extend from the blank for folding upward and forming sidewalls. The blank includes a front wall fold line defining a front wall flap portion for folding upward and forming a front wall portion.

A rear wall fold line is spaced from the front wall fold line and is substantially parallel thereto and defines a bottom wall portion between the front wall and rear wall fold lines. The rear fold line also defines a rear wall flap member portion.

The rear wall flap member portion includes a plurality of horizontally extending fold lines which define an interior rear wall portion for folding over the interior of the rear wall and also a bottom wall flap member for overlying the bottom wall.

The bottom wall flap member includes a plurality of substantially parallel and horizontal fold lines positioned on the bottom wall flap member for folding and forming a plurality of article carrying rows overlying the bottom wall portion. In one advantageous embodiment, there are five fold lines which form a double-U configuration and form a dual row display tray when the display tray is erected. A plurality of spaced openings are formed along the fold lines and are aligned with each other so that when the bottom wall flap member is folded and overlies the bottom wall, a plurality of article carrying rows are formed for receiving articles having projections where the projections on the articles to be carried are received within the openings and retained within the article carrying rows.

The side wall flap portion advantageously includes a horizontal fold line defining a bottom wall extension flap for folding transverse to the sidewalls for reinforcing the bottom wall when the display tray is erected. In addition, a diagonal fold line is included on opposing side flap portions for allowing folding of a portion of the side flap portions over upon themselves to form a sidewall multi-layer panel thickness which is tapered downward from the rear wall to the front wall when the display tray is erected.

BRIEF DESCRIPTION OF THE DRAWINGS

Some of the advantages of the present invention having been stated, others will be more fully understood from the detailed description which follows and by reference to the accompanying drawings in which.

DETAILED DESCRIPTION

Figures 1, 2:
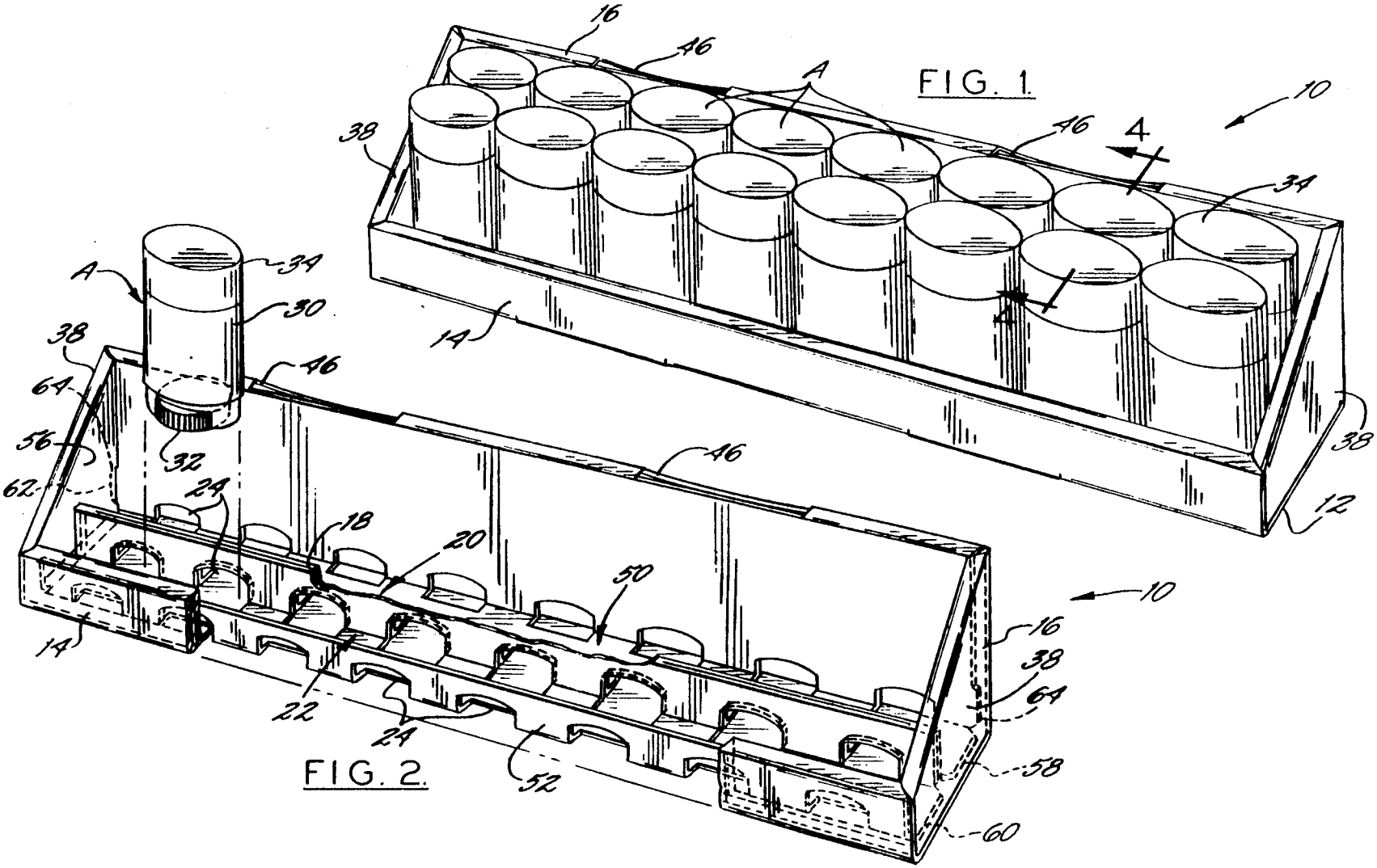
FIG. 1 is a perspective view of the display tray in accordance with one embodiment of the present invention and showing a plurality of articles retained within the article carrying rows.
FIG. 2 is a view similar to FIG. 1 and showing a portion of the front wall cut-away and the upward extending front flap wall member positioned adjacent the front wall.

In the drawings and specification, there is disclosed a typical preferred embodiment of the invention, and although specific terms are employed throughout the description, they are used in a generic and descriptive sense only, and not for purposes of limitation.

As shown in FIG. 1, there is illustrated one embodiment of the display tray of the present invention indicated generally at 10. The display tray 10 includes a tray body having a bottom wall 12, opposing front and rear walls 14, 16 and an open top. At least one support wall 18 is spaced between front and rear walls 14, 16 and extends upward from the bottom wall 12 to define a plurality of article carrying rows, which in the illustrated embodiment are two article carrying rows indicated at 20 and 22 for forming a dual row display tray (FIG. 2). Although only two article carrying rows 20, 22 are illustrated, the display tray 10 can include two or more article carrying rows.

A plurality of openings 24 (FIG. 2) are positioned in each of the front, rear and support walls 14, 16 and 18 adjacent to the bottom wall 12 for receiving projections of articles A to be carried in the display tray 10 and retaining the articles in the article carrying row. In the illustrated dual row display tray, two rows of nine sets of openings 24 are illustrated for containing nine articles A in each row. The overall length of the display tray can be varied for allowing a fewer or larger number of articles in each row. The article carrying rows 20, 22 are dimensioned so that the distance between front, rear and support walls 14, 16, 18 is such that the sides of an article are engaged by the front, rear and support walls when the article is carried in the display tray 10.

Figure 3:
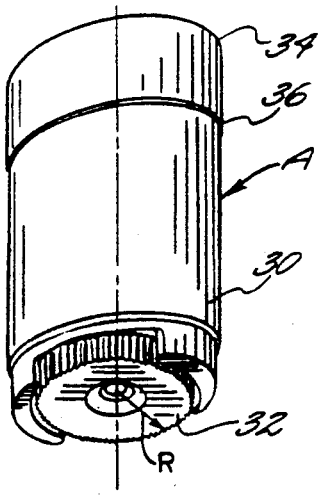
FIG. 3 is a perspective view of one type of article which can be retained in the article carrying rows of the display tray.

Any articles A retained in the display tray 10 generally include projections on the bottom portion thereof which are received within the openings 24 positioned adjacent to bottom wall 12 on the front, rear and support walls 14, 16, 18. Many different articles can be received within the display tray 10 and the display tray forms an article holding tray for displaying different articles in the article carrying rows. Those types of articles A having projections on the bottom portion such as illustrated in FIGS. 2 and 3 are best suited for use with the present invention because the article projections can be inserted in openings of the article carrying row. In FIG. 3, there is illustrated a conventional deodorant stick article A which can be received in the display tray 10.

The illustrated deodorant stick article A is the conventional type commercially available at many stores and includes an oval configured cylindrical carrying body 30 having an oval configured solid deodorant stick (not shown) contained therein. A projection, which operates as an adjustment knob 32, is positioned on the bottom of the carrying body and is connected to a support plate positioned in the carrying body 30 on which the deodorant stick is secured. As the adjustment knob 32 is rotated, the deodorant stick is raised out of the carrying body 30. A user grasps the projecting portion of the adjustment knob 32 and rotates the adjustment knob to raise the solid deodorant stick out of the carrying body 30. An oval configured top 34 is positioned on the carrying body 30 and extends over a top flange portion to engage a shoulder 36.

Figure 4:
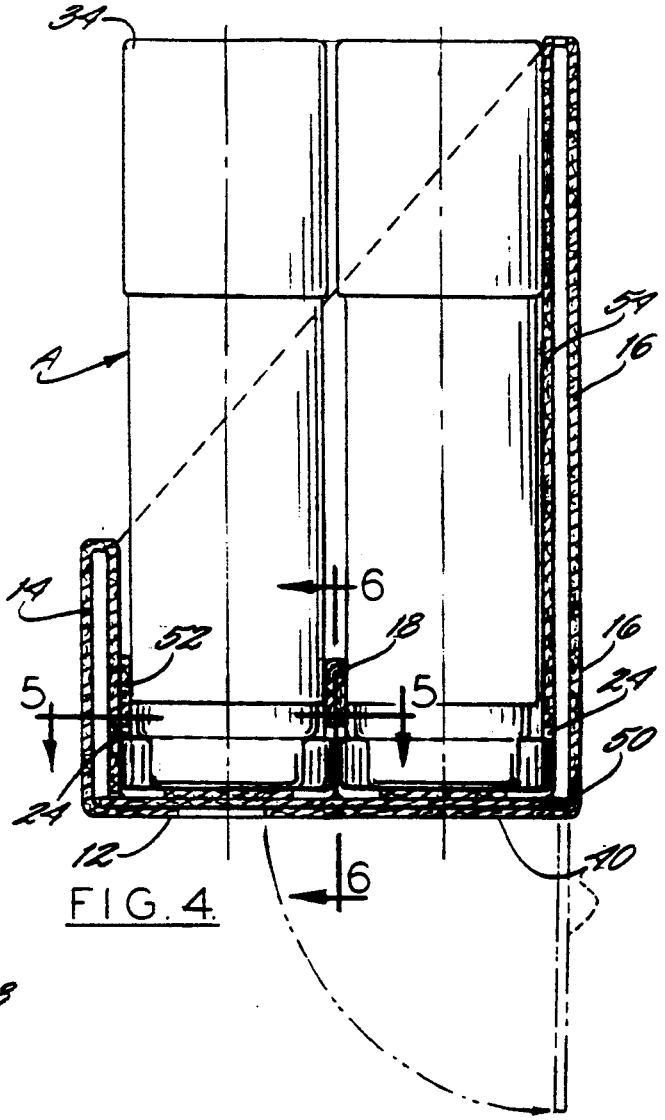
FIG. 4 is a sectional view taken along line 4—4 of FIG. 1.
Figure 5:
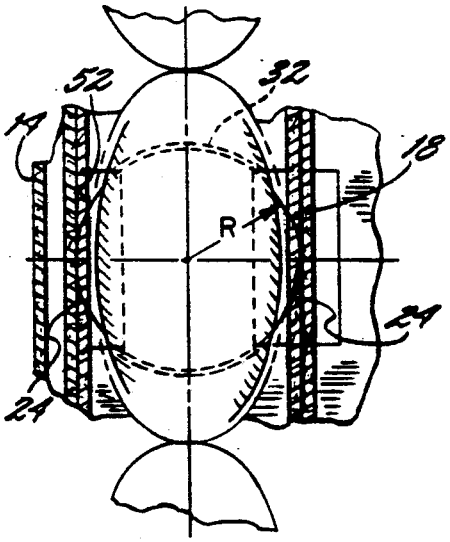
FIG. 5 is a sectional view taken along line 5—5 of FIG. 4 and showing the adjustment knob of an article positioned in the openings adjacent the bottom wall.
Figure 6:
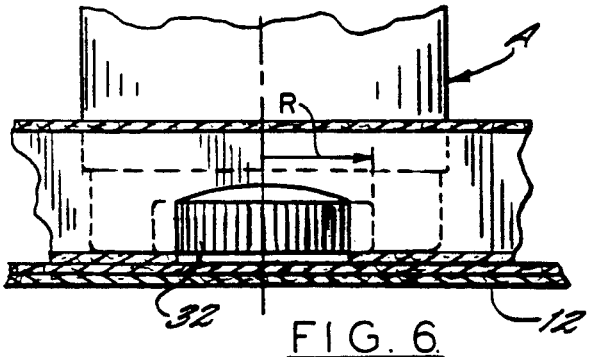
FIG. 6 is a sectional view taken along line 6—6 of FIG. 4.

As illustrated in FIGS. 4 and 5, the openings 24 are dimensioned for receiving the adjustment knob 32 and forming a frictional fit so that the adjustment knob is retained in the openings 24. Preferably, the walls are dimensioned so that the space between front, rear and support walls allows frictional engagement of the walls with the carrying body 30. This aids in retaining the articles A in the article carrying rows.

The display tray 10 is formed advantageously of 200 pound E flute paper. Although different types of paper and weights can be used, a 200 pound E flute material has been found advantageous and provides rigidity to the display tray while being resilient enough to enable insertion and removal of the articles A. Typically, E flute material has a main corrugated web and outer surfaces of Kraft or other paper secured onto the corrugated web.

In the illustrated embodiment, the rear wall 16 is of greater height than the front wall 14. Tray sidewall panels 38 serve as tray sidewalls and are tapered downward from the rear wall 16 toward the front wall 14. Preferably, the rear wall 16 is a height substantially equal to or less than the height of the articles to be carried (FIG. 1). More preferably, the rear wall is a height substantially equal to the height of the articles to provide additional support. This provides a display tray 10 having a top surface formed by the top surfaces of the articles A retained therein on which a second display tray 10 can be positioned on top of the articles (FIG. 7) for allowing stacking of one tray one on top of the other.

Figure 8:
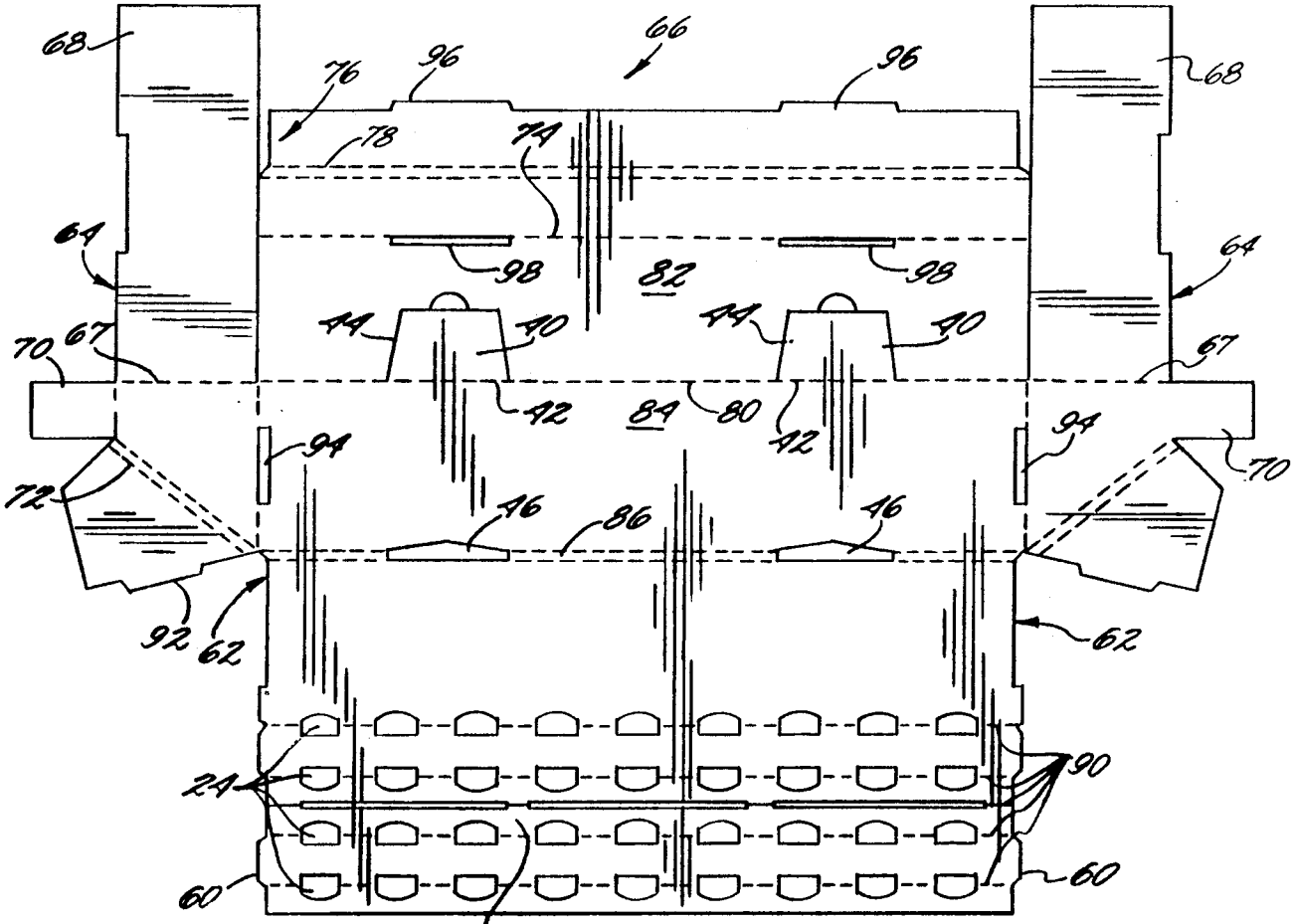
FIG. 8 is a plan view of one advantageous blank design used for forming one embodiment of the display tray in accordance with the present invention.
Figure 7:
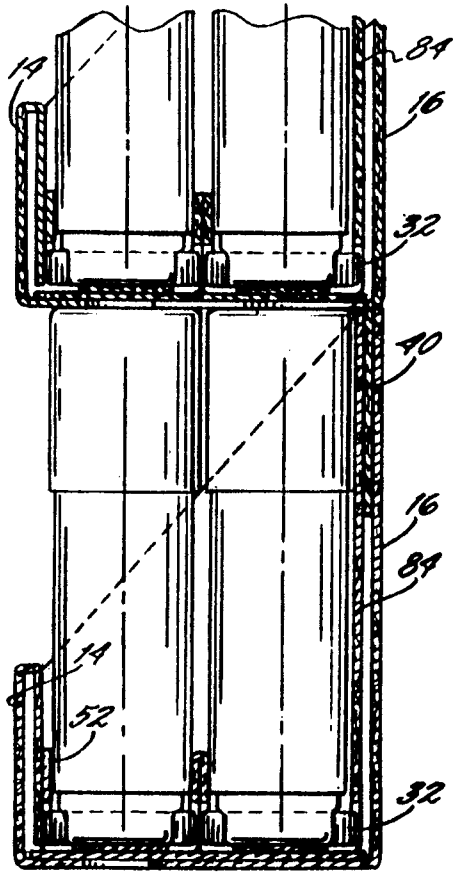
FIG. 7 is an side elevation sectional view showing stacking one on top of the other of display trays and showing the tear-out flap panel received into the rear wall of an underlying display tray.

In the illustrated embodiment, the bottom wall 12 advantageously includes means defining a tear-out flap panel 4*c* (FIGS. 4 and 8) which engage the rear wall 16 of another display tray 10 for allowing interconnection of a plurality of the display trays 10 when stacking of the trays, one on top of the other (FIGS. 4 and 8). As shown in the drawing of the blank shown in FIG. 8, the illustrated tear-out flap panel 40 comprises a fold line 42 on the bottom wall 12. A portion of the bottom wall 12 is defined by lines of weakening 44 on the bottom wall which interconnect the fold line 42 to form a somewhat rectangular configured tear-out flap panel. The lines of weakening 44 can include score lines, intermittent openings or other means forming a line of weakening in which the tear-out flap member is separable from the bottom wall along the lines of weakening for folding outward along the fold line 42. Means for receiving the tear-out flap panel 40 on the rear wall 16 includes a slot opening 46 in the multi-panel rear wall (FIGS. 1 and 2). The slot opening 46 is dimensioned for receiving the tear-out flap panel 40 (FIG. 7). When one display tray 10 is stacked one on top of the other, the tear-out flap panel 40 allows interconnection of the stacked display trays.

In the illustrated embodiment, a bottom wall flap member 50 overlies the bottom wall 12 and is folded to form at least one support wall 18 spaced between the front and rear walls (FIGS. 2 and 4). As noted above, the support wall 18 extends upward from the bottom wall 12 to form a plurality of article carrying rows. The bottom wall flap member 50 is formed from a larger panel which is folded in a double-U configuration to form two article carrying rows 20, 22. As noted before, the present invention is not limited to a dual row display tray having two article carrying rows. Depending upon the desired dimensions of the display tray, the bottom wall flap member 50 can be folded to form a greater number of article carrying rows 20, 22 by forming two or more support walls positioned between the front and rear walls of a display tray.

The bottom wall flap member 50 includes front and rear upward extending flap wall members 52, 54 positioned adjacent the interior of respective front and rear walls 14, 16 of the tray body 11 (FIG. 4). The rear flap wall member 54 extends upward the height of the rear wall 16 and is connected to the rear wall 16 to form a rear wall 16 having a multi-layer panel thickness. The front upward extending flap wall member 52 is positioned adjacent the interior of the front wall of the tray body 10 and extends upward about one-half the height of the front wall. The openings are positioned adjacent the bottom wall in the support wall 18 and in the front and rear upward extending flap wall members 52, 54 for receiving the projections of those articles to be carried in the display tray 10 and retaining the articles in the article carrying rows.

Advantageously, the bottom wall flap member 50 is retained in overlying engagement with the bottom wall 12 to prevent the bottom wall flap member 50 from moving out of engagement with the bottom wall 12. Each tray side wall panel 30 includes an interior wall panel 56 (FIG. 2) having a lower edge spaced from the bottom wall and forming a slot opening shown in dotted lines at 58 adjacent the bottom wall 12. The bottom wall flap member 50 includes side member extensions shown in dotted lines at 60 which are dimensioned for fitting within the formed slot openings 58 for maintaining the bottom wall flap member 50 in overlying engagement to the bottom wall 12. Each interior side wall panel 50 also forms a slot opening 62 for receiving the side member extensions 64 on the interior rear flap wall member 54 therein to maintain the rear flap wall member 54 against the rear wall 16 of the tray body.

As shown in FIG. 8, one advantageous blank design for forming the display tray in accordance with the present invention is indicated generally at 66. The blank includes generally a main rectangular blank portion, indicated generally at 62 having opposing side flap portions indicated generally at 64 extending from the blank for folding upward and forming sidewalls. Each side flap portion 64 includes a horizontal score line 67 defining a bottom wall extension flap 68 for folding transverse to the side walls for reinforcing the bottom wall when the display tray is erected. A front wall extension flap 70 extends outward from the side flap portion and is adapted for folding upward and forming a reinforcing flap on which the front wall extends around. Each side flap portion 64 advantageously includes a diagonal fold line 72 for allowing folding of the side flap portions over upon themselves to form a side wall having a multi-layer panel thickness which is tapered downward from the rear wall to the front wall when the display tray is erected.

The blank includes a front wall fold line 74 defining a front wall flap portion indicated generally at 76 for folding upward and forming a front wall when the display tray 10 is erected. The front wall flap portion 76 includes two medially positioned fold lines 78 for allowing folding of the front wall flap portion over the front wall extension flap 70 when the display tray is erected to form a front wall having a multi-panel wall thickness. A rear wall fold line so is spaced from the front wall fold line 74 and is substantially parallel thereto and defines a bottom wall portion 82 positioned between the front wall and rear wall fold lines 74, 80. The rear wall fold line 80 also defines a rear wall flap member portion 84 opposite the bottom wall portion 82. The bottom wall portion includes a fold line 42 and a cut score line 44 forming the tear-out flap panel 40.

The rear wall flap member portion 84 includes two horizontally extending fold lines 86 for allowing folding of the rear wall flap member portion 84 over itself to form an interior rear wall panel portion for folding into engagement with the rear wall when the tray is erected and to form a rear wall having a multi-panel thickness. The two spaced openings 46 are positioned on the fold lines 86 for forming a slot opening 46 on the upper portion of the rear wall when the display tray is erected for receiving the tear-out flap panels 40 of a second tray when the trays are stacked one on top of the other. The rear wall flap member portion 84 is dimensioned so that when folded, a portion also overlies the bottom wall member and forms the bottom wall flap member 50 when the display tray 10 is erected.

A plurality of substantially parallel and horizontal fold lines 90 are positioned on the bottom wall flap member and are adapted for folding upon themselves to form the plurality of article carrying rows overlying the bottom wall portion. The bottom wall flap member 50 advantageously includes five substantially parallel and horizontal fold lines 90. The bottom wall flap member 50 is folded along these lines to form a double-U configured bottom wall flap member for overlying the bottom wall when a display tray is erected. As illustrated, when the tray is erected the double-U configuration includes a support wall 18 and a front wall flap member 52 which is positioned adjacent the interior of the front wall. The rear wall flap member 54 extends upward against the rear wall.

Each of the first, second, fourth and fifth fold lines 90 includes a plurality of the spaced openings 24 formed along the fold lines and being aligned with each other so that when the bottom wall flap members are folded and overly the bottom wall, a plurality of article carrying rows 20, 22 are formed having openings for receiving articles with projections wherein the projections on the articles to be carried are received within the openings.

To erect the display tray 10 in accordance with the illustrated blank design, the bottom wall extension flaps 68 on the side flap portions 64 are first folded upward 90°. The side flap portions 64 are then folded along the diagonal fold line 72 and the side flap portion is raised into vertical orientation. Each side flap includes a locking member extension 92 for fitting within a slot opening 94 on the bottom wall portion when the side flap portions are erected.

The bottom wall portion 82 is folded and then the front wall portion is folded upon itself and upon the front wall extension flap members positioned on the side flap portions 92. The front wall portion is locked into place by front wall locking member extensions 96 which are received into slot openings 98 formed in the bottom wall. The rear wall flap member portion 84 is folded to form the rear wall, the interior rear wall panel portion, and bottom wall flap member which overlies the bottom wall. The bottom wall flap member 50 is secured in overlying engagement to the bottom wall by means of the side member extensions 60 which are received within the formed slot openings 58. The rear wall flap member 54 is secured by the side member extensions which are retained in slot openings formed by the folded side flap portions so that the rear wall flap member 54 is retained in engagement with the interior of the rear wall. After the display tray is erected, the articles A are placed within the rows. In the case of the illustrated carrying body 30, the projecting portion of the adjustment knob 32 extends into the openings 24. The openings 24 are dimensioned for receiving the adjustment knob 32 in a frictional fit for retaining the articles A in the article carrying rows. Thus, the display tray 10 can be rotated or carried vertically and the articles retained therein.

The display tray 10 can be manufactured as a blank and sold to a manufacturer and distributor of those articles to be merchandised within the display tray 10. The dimensions of the display tray can vary, depending upon the type of article to be displayed. Any number of article carrying rows can be formed depending on the desired dimensions of the display tray and the needs of the retailer. In closely confined spaces of a retail store, the display trays preferably can be stacked one on top of the other in accordance with the present invention.

It will be recognized that numerous variations can be made within the spirit and scope of the invention as described in the foregoing specification and as defined in the following claims.

That which is claimed is:

1. A display tray comprising a tray body having a bottom wall, opposing front and rear walls and an open top, at least one support wall spaced between front and rear walls forming a plurality of article carrying rows and extending upward from the bottom wall to define a plurality of article carrying rows, and a plurality of openings positioned in the front, rear and support walls adjacent the bottom wall for receiving projections of articles to be carried in the display tray and retaining the articles in the article carrying rows wherein said rear wall is substantially equal to the height of the articles to be carried within the display tray and substantially higher than the front wall.

2. A display tray according to claim 1 wherein said display tray is formed from a single sheet of paperboard material.

3. A display tray according to claim 1 wherein the article carrying rows are dimensioned so that the distance between front, rear and support walls is such that the sides of an article are engaged when the article is carried.

4. A display tray according to claim 1 wherein said front wall includes an interior front wall panel, said openings adjacent the bottom wall in the front wall being positioned in said interior front wall panel.

5. A display tray according to claim 1 wherein said rear wall includes an interior rear wall panel, said openings adjacent the bottom wall in the rear wall being positioned in said interior rear wall panel.

6. A display tray according to claim 5 wherein said rear wall comprises a rear wall including an interior rear wall formed by folding a panel of substantially the same size as said rear wall against the interior of said rear wall along a fold line at the top edge of said rear wall substantially equal to the height of the articles to be carried within the display tray, and including at least one slot formed in the top edge of said double rear wall, and further including a tear out flap panel adapted to be interconnected with another tray.

7. A display tray comprising a tray body having a bottom wall, opposing front and rear walls and an open top, a bottom wall flap member overlying said bottom wall, said bottom wall flap member being folded to form at least one support wall spaced between said front and rear walls and extending upward from the bottom wall to form a plurality of article carrying rows, said bottom wall flap member including front and rear upward extending flap wall members positioned adjacent the interior of respective front and rear walls of the tray body, said front and rear flap wall members and said support wall each including a plurality of openings adjacent the bottom wall and dimensioned for receiving projections of articles to be carried in the display tray and retaining the articles in the article carrying rows; said tray walls each include an interior wall panel having a portion of the lower edge spaced from the bottom wall and forming a slot opening adjacent to the bottom wall, and said bottom wall flap member including side locking extensions dimensioned for fitting within said slot openings for maintaining said bottom wall flap member overlying engagement with said bottom wall.

8. A display tray according to claim 7 wherein said rear flap wall member extends upward the height of said back wall and is integrally connected to said back wall to form a back wall having a multi-layer panel thickness.

9. A display tray according to claim 7 wherein said bottom wall includes means for defining a tear-out flap panel, said rear wall includes mean for receiving a tear-out flap panel from a bottom wall for allowing interconnection of a plurality of said display trays when stacking of said trays one on top of the other.

10. A display tray according to claim 9 wherein said means for defining a tear-out flap panel comprises a fold line on said bottom wall, and a portion of said bottom wall defined by lines of weakening on said bottom wall and interconnecting said fold line, said tear-out flap member being separable from said bottom wall along said lines of weakening formed on said bottom wall for folding outward along said fold line.

11. A blank for forming a display tray comprising a rectangular blank having opposing side flap portions extending form the blank for folding upward and forming sidewalls, said blank including a front wall fold line defining a front wall flap portion for folding upward and forming a front wall portion, a rear wall fold line spaced from the front wall fold line and substantially parallel thereto and defining a bottom wall portion between the front wall and rear wall fold lines and a rear wall flap member portion, said rear wall flap member portion including a plurality of horizontally extending fold lines defining both an interior rear wall portion for folding over the interior of the rear wall, and a bottom wall flap member for overlying the bottom wall, said bottom wall flap member including a plurality of substantially parallel fold lines positioned on said bottom wall flap member for folding upon themselves to form a plurality of article carrying rows overlying the bottom wall portion, each of said opposing side flap portions includes a diagonal fold line for allowing folding of the side flap portion over upon itself to form a side wall multi-layer panel thickness which is tapered downward from the rear wall to the front wall when the display tray is erected, a plurality of spaced openings formed along some of the fold lines and being aligned with each other so that when the interior bottom wall flap member is folded and overlies the bottom wall, and a plurality of article carrying rows are formed when said display tray is erected for receiving articles having projections wherein the projections on the articles to be carried are received within said openings.

12. A blank according to claim 11 wherein said side flap portions include a horizontal fold line defining a bottom wall extension flap for folding transverse to said side walls for reinforcing said bottom wall when said display tray is erected.

13. A blank according to claim 11 wherein said bottom wall flap member includes five substantially parallel and horizontal fold lines positioned on said bottom wall flap member for folding and forming a double-U configured bottom wall flap member overlying the bottom wall.

* * * * *

UNITED STATES PATENT AND TRADEMARK OFFICE

CERTIFICATE OF CORRECTION

PATENT NO. : 5,180,052

DATED : January 19, 1993

INVENTOR(S) : Raymond D. Smith, et al.

It is certified that error appears in the above-identified patent and that said Letters Patent is hereby corrected as shown below:

On the title page, item [56] References Cited:
In the references, "4,753,241" should be --4,753,341--.

In the references, date of United Kingdom patent is incorrect: should be --8/1940--.

Column 5, line 36, "4c" should be --40--.

Column 6, line 67, "so" should be --80--.

Column 9, line 27, "mean" should be --means--.

Column 9, line 41, "form" should be --from--.

Signed and Sealed this

Thirtieth Day of November, 1993

Bruce Lehman

*Attest:*

BRUCE LEHMAN

*Attesting Officer*

*Commissioner of Patents and Trademarks*